United States Patent [19]

Lee

[11] Patent Number: 4,901,497

[45] Date of Patent: Feb. 20, 1990

[54] FASTENER FOR FORM PANELS

[76] Inventor: Yuan-Ho Lee, No. 851, Chung-San Rd., Nan-Pao Tsun, Kuei-Jen Hsian, Tainan Hsieng, Taiwan

[21] Appl. No.: 370,851

[22] Filed: Jun. 23, 1989

[51] Int. Cl.[4] ..... E04G 17/04

[52] U.S. Cl. ..... 52/582; 152/585; 249/192; 249/196; 249/47; 403/300

[58] Field of Search ..... 52/127.7, 582, 585, 52/584; 403/300, 305, 402; 249/192, 196, 47

[56] References Cited

U.S. PATENT DOCUMENTS

| | | | |
|---|---|---|---|
| 2,863,683 | 12/1958 | Peterson et al. | 403/300 |
| 3,244,248 | 4/1966 | Prickett | 52/582 X |
| 3,986,315 | 10/1976 | Nungesser | 52/584 |

FOREIGN PATENT DOCUMENTS

| | | | |
|---|---|---|---|
| 3017103 | 11/1981 | Fed. Rep. of Germany | 52/585 |

*Primary Examiner*—Carl D. Friedman
*Assistant Examiner*—Lan Mai
*Attorney, Agent, or Firm*—Ladas & Parry

[57] ABSTRACT

A fastening device to fasten at least two edge-to-edge contiguous panel facings includes a plurality of looped members projecting from the back face of each panel facing along the longitudinal sides thereof. Each looped member has an engagement face spaced parallely from the back face and two opposed angled flanks connected to the back face. Key members are to be inserted into the looped members, each having an insert rod portion and a handle rod portion which forms an angle with the insert rod portion, the insert rod portion having a pair of first opposed longitudinal faces, and a pair of second opposed longitudinal faces. The distance between the first opposed faces is smaller than the distance between the engagement face and the back face so that the insert rod portion can be inserted into two aligned looped members, and the distance between the second opposed faces is greater than the distance between the engagement face and the back face. The second opposed faces engage with the engagement face and the back face when the insert rod portion is turned an angle after being inserted.

2 Claims, 4 Drawing Sheets

FASTENER FOR FORM PANELS

BACKGROUND OF THE INVENTION

This invention relates to a fastener for a form assembly and particularly to a fastener which includes looped members and key members to be inserted in the looped members.

It is now a common practice to assemble modular form panels into a large form board which can be stripped entirely from a formed concrete structure and which can be used repeatedly to form similar concrete structures without the need to dissemble and reassemble the form board. Various kinds of fasteners are provided to fasten panel units which constitute form assemblies in the art. In most of the known form assemblies, form panel units are interconnected by means of fasteners or connectors which are provided at adjacent backing members rather than on the panel facing of the form assemblies. For example, a typical steel ply form panel includes a rectangular plywood facing secured to a rectangular steel reinforcing frame which includes vertical and horizontal bars projecting rearward from the form panel. The sides of the panel are bounded by two parallel vertical bars which are used to be connected to the vertical members of other form panels. In such a kind of form panel, vertical bars are abutted against one another and fastened to one another by means of wedge bolts each of which are inserted tightly in a slot of a cross piece which is threaded through two aligned slots of abutting bars.

SUMMARY OF THE INVENTION

An object of the invention is to provide a form panel fastener which connect two edge-to-edge adjacent panel facings of adjacent modular panel units, thereby minimizing the creation of clearances between adjacent panel units.

The present invention provides a fastening device to fasten at least two edge-to-edge contiguous panel facings each of which has two opposite longitudinal sides, two opposite transverse sides and a back face. The fastening device includes a plurality of looped members projecting from the back face of each of the panel facings along the longitudinal sides thereof, the looped members of one of the panel facings being respectively aligned with the looped members of an adjacent the panel facing, each looped member having an engagement face spaced parallely from the back face of the panel facing and two opposed flanks extending from two sides of the engagement face of the looped member and connected to the back face. The distance between the flanks is greater than that between the engagement face and the back face. Each key member to be inserted into the looped members has an insert rod portion to be inserted in at least two aligned looped members and a handle rod portion which forms an angle with the insert rod portion. The insert rod portion has a pair of first opposed longitudinal faces, and a pair of second opposed longitudinal faces. The distance between the first opposed faces is smaller than the distance between the engagement face and the back face so that the insert rod portion can be inserted into aligned looped members. The distance between the second opposed faces is greater than the distance between the engagement face and the back face so that the second opposed faces are engaged respectively with the engagement face and the back face when the insert rod portion is turned an angle after being inserted.

The present exemplary preferred embodiment will be described in detail with reference to the accompanying drawings, in which:

DETAILED DESCRIPTION OF THE PREFERRED EMBODIMENT

Figure 1:
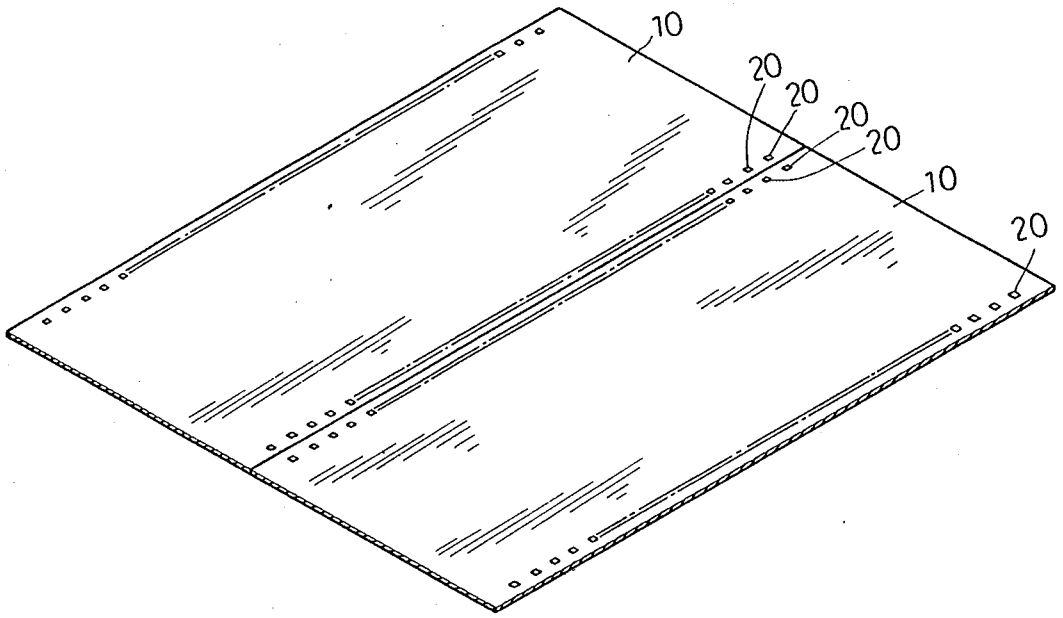
FIG. 1 is a perspective view of two panel facings which are provided with fasteners of the present invention.
Figure 2:
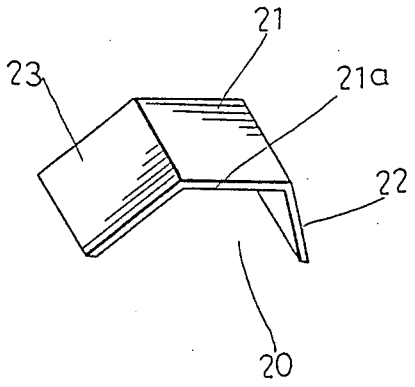
FIG. 2 shows a looped member of a fastener according to the present invention.
Figure 3:
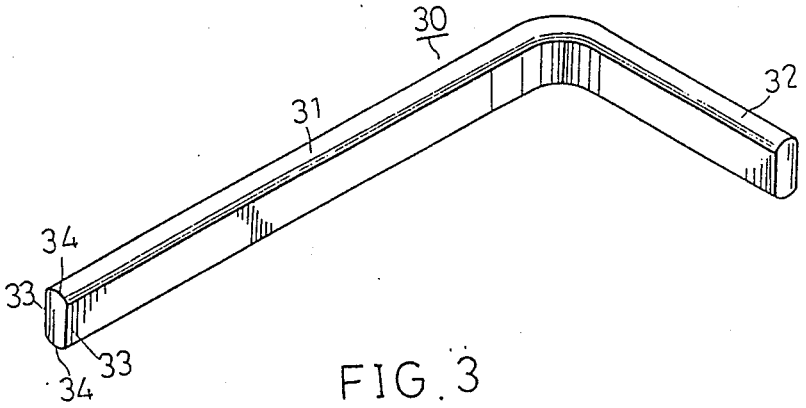
FIG. 3 is a key member to be inserted into the looped member.

Referring to the drawings, a fastening device embodying the present invention is used for fastening two adjacent panel facings 10 each of which will be connected a backing frame to constitute a form panel unit. The backing frame is detachably connected to the panel facings. The type of form panel unit is disclosed in a copending application of the inventor of the application.

The fastening device includes a plurality of looped members 20 provided along adjacent longitudinal sides of the panel facing 10 and a plurality of key members 30 to be inserted in the looped members 20. The looped members 20 on one of the panel facings 10 are respectively aligned with the looped members 20 on the adjacent panel facing 10.

Each looped member 20 has a substantially planar engagement member 21 with an inner engagement face 21*a* and two flanks 22, 23 which are welded to the back face of each panel facing. The engagement member 21 and the flanks 22, 23 of each looped member confine an opening with the back face of the panel facing.

The fastener means to fasten the form panels also includes key members 30 each having an insert rod portion 31 to be inserted in two aligned looped members 20 and a handle rod portion 32 which forms an angle with the insert rod portion 31. The insert rod portion 31 has a substantially rectangular cross-section and has both a pair of first opposed longitudinal faces 33 and a pair of second opposed longitudinal faces 34. The length between the first opposed faces 33 is smaller than that between the engagement face 21*a* and the back face of the panel facing 10 so that the insert rod portion 31 can be inserted into the aligned looped members 20. The length between the second opposed faces 34 is greater than that between the engagement face 21*a* and the back face of the panel facing 10 so that the faces 34 engage respectively with the engagement face 21*a* of the looped member 20 and the back face of the panel facing 10 when the insert rod portion 31 is turned 90 deg after being inserted. Preferably, the opposed faces 34 are slightly convexed so that the key member 30 can be turned smoothly.

In operation, two panel facings are arranged in edge-to-edge contiguity and the looped members are aligned respectively. The key members 30 are inserted into the aligned looped members 20 and then turned 90 deg to cause the insert rod portions of the key members to engage tightly with the looped member, thereby fastening the panel facings 10.

Preferably, the panel facings are made of a steel plate having a thickness of 4 mm and a dimension of 3400×1260 sq.mm. The distance between two adjacent looped members is arranged to be about 100 mm.

Figure 4:
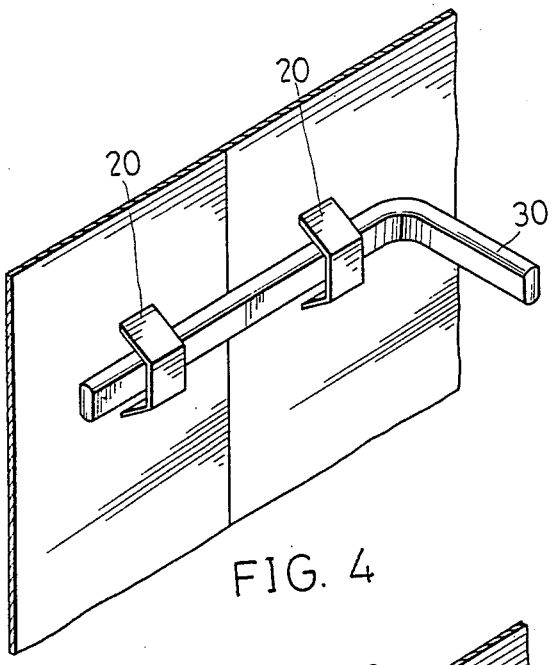
FIGS. 4 and 5 show how the panel facings are fastened by the looped member and key member.
Figure 5:
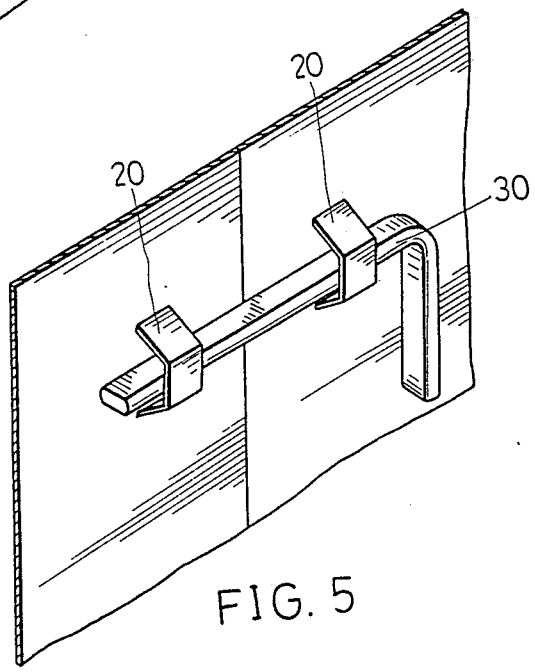
Figure 6:
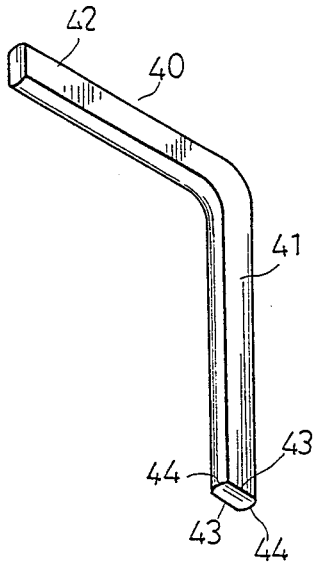
FIG. 6 shows an alternative form of the key member.

As shown in FIGS. 4 and 5, the insert rod portion of the key member 30 is longer than the handle portion, and the handle portion is turned to be in contact with the panel facing 10 when the key member is locked in the looped member. This fastener is suitable for fastening vertical panel facings.

As shown in FIG. 5 an alternative key 40 has a handle portion 41 which is longer than the insert portion 42 thereof. The key 40 also has a rectangular cross-section, being formed with two opposed engaging faces 44 and another two opposed faces 43. The engaging faces 44 will engage with the engagement face of the looped member and the back face of the panel facing when the key member 40 is in a locked position. The difference between the key members 30 and 40 is that the handle portion 41 projects from the panel facing 10 downwardly when in the locked position. This form is suitable for fastening panel facings to be arranged horizontally during the formation of a ceiling so that an operator can conveniently operate the key member 40 below the form.

With the invention thus explained, it is apparent that various modifications and variations can be made without departing from the scope of the invention. It is therefore intended that the invention be limited only as indicated in the appended claims.

What I claim is:

1. A fastening device to fasten at least two edge-to-edge contiguous panel facings each of which has two opposite longitudinal sides, two opposite transverse sides and a back face, comprising a plurality of looped members projecting from said back face of each of the panel facings along said longitudinal sides, said looped members of one of said panel facings being respectively aligned with said looped members of an adjacent said panel facing, each of said looped members having an engagement face spaced parallely from said back face and two opposed flanks extending from two sides of said engagement face and being connected to said back face, the distance between said flanks being greater than that between said engagement face and said back face, and key members each having an insert rod portion to be inserted in at least two aligned said looped members and a handle rod portion which forms an angle with said insert rod portion, said insert rod portion having a pair of first opposed longitudinal faces, and a pair of second opposed longitudinal faces, the distance between said first opposed faces being smaller than the distance between said engagement face and said back face so that said insert rod portion can be inserted into aligned said looped members, the distance between said second opposed faces being greater than the distance between said first opposed faces, said second opposed faces being engaged respectively with said engagement face and said back face when said insert rod portion is turned a certain angle after being inserted.

2. A fastening device as claimed in claim 1, wherein said insert rod portion has a substantially rectangular cross-section, and said second opposed faces are slightly convexed.

* * * * *